United States Patent [19]

Neumann

[11] 4,341,491

[45] Jul. 27, 1982

[54] EARTH RETAINING SYSTEM

[76] Inventor: Albert Neumann, 5401 Graywing Ct., Columbia, Md. 21044

[21] Appl. No.: 684,371

[22] Filed: May 7, 1976

[51] Int. Cl.[3] ..... E02D 17/20

[52] U.S. Cl. ..... 405/258; 405/262; 405/284

[58] Field of Search ..... 61/35, 39, 49, 36, 4, 61/30; 405/258, 262, 284–287, 272, 273

[56] References Cited

U.S. PATENT DOCUMENTS

| | | | |
|---|---|---|---|
| 554,680 | 2/1896 | Haentges | 61/39 UX |
| 1,937,781 | 12/1933 | Patton | 61/39 |
| 1,947,151 | 2/1934 | Caples | 61/39 |
| 2,018,920 | 10/1935 | Mette | 61/39 |
| 2,138,037 | 11/1938 | Lane | 61/35 |
| 2,193,425 | 3/1940 | Lake | 61/35 X |
| 3,316,721 | 5/1967 | Heilig | 61/39 |

FOREIGN PATENT DOCUMENTS

| | | | |
|---|---|---|---|
| 558564 | 12/1957 | Belgium | 61/39 |
| 830584 | 8/1938 | France | 61/39 |

*Primary Examiner*—Dennis L. Taylor
*Attorney, Agent, or Firm*—Morton J. Rosenberg

[57] ABSTRACT

An earth retaining system defining a tension loaded structure for positionally maintaining horizontal and vertically displaced loads. The tension loaded structure includes frontal walls having an elliptical contour which are fixedly secured to a wire mesh screen rear wall structure through tension rods passing therebetween. The frontal walls are fastened on opposing transverse edges thereof to vertically directed support members. Adjacent frontal walls are adapted to matingly engage one to the other through releasable interlocking edges. The arcuate contour of the frontal walls are designed to minimize bending moments that may occur due to horizontal or vertical loads applied to the structural system. The rear walls are aligned in a longitudinal direction with the frontal walls and are maintained in an elliptical contour similar to the frontal walls. Granular material having a size substantially greater than the mesh screen size of the rear walls is positionally placed on opposing surfaces of the rear walls internal and external respectively to the structural system. The internal portion or volume of the structural system defined by the peripheral boundaries of the frontal walls, tension rods, and rear walls is filled with a granular material having an angle of friction greater than 22°.

27 Claims, 10 Drawing Figures

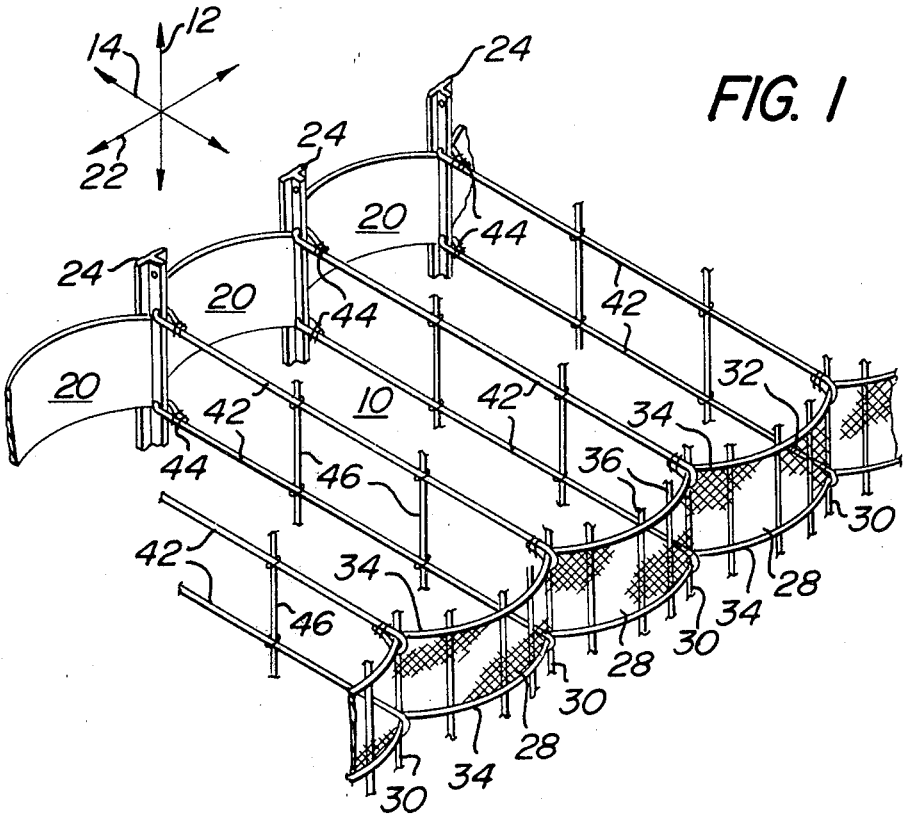
FIG. 1
FIG. 2
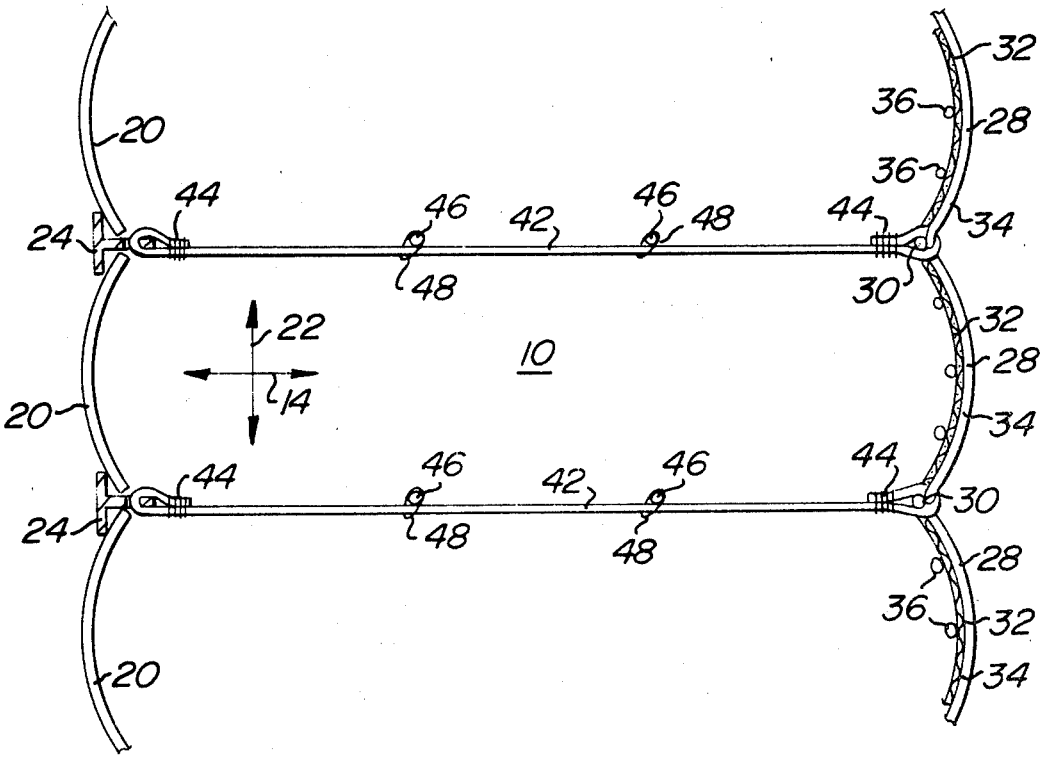

FIG. 3
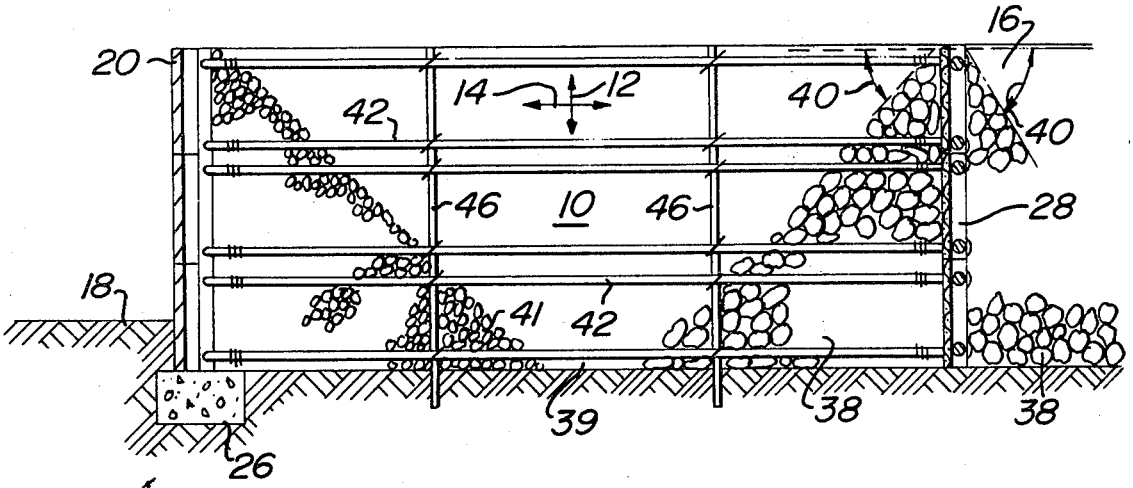
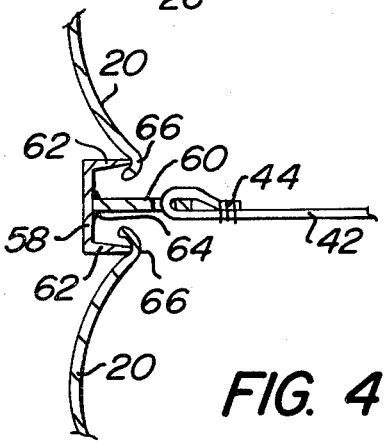
FIG. 4
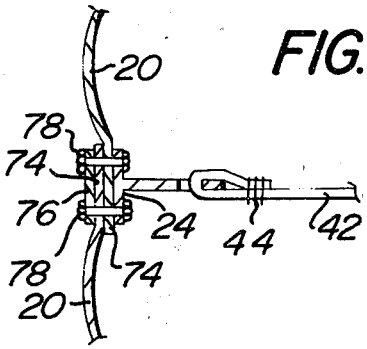
FIG. 6
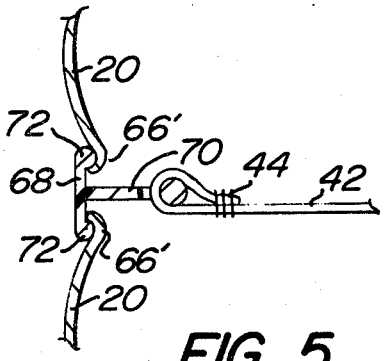
FIG. 5
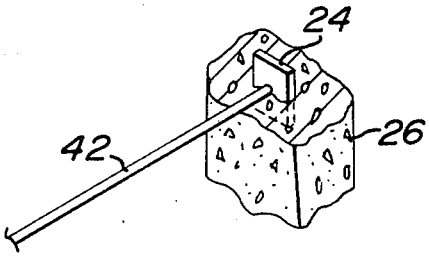
FIG. 7

FIG. 8
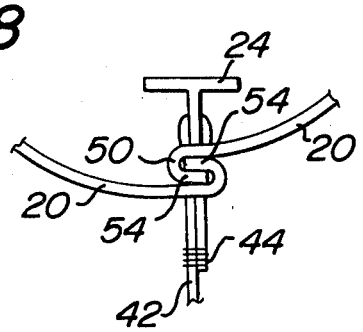
FIG. 9
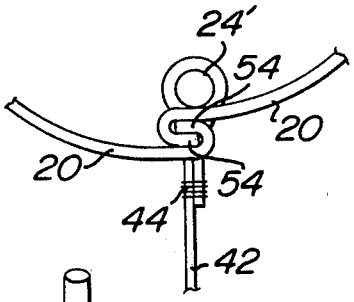
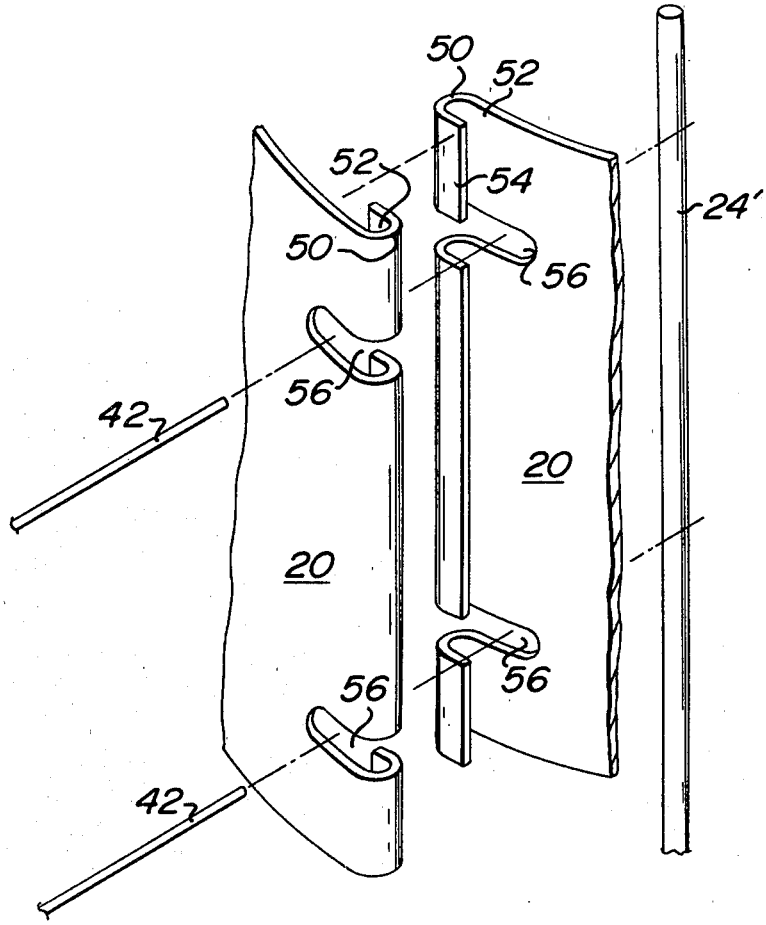
FIG. 10

EARTH RETAINING SYSTEM

BACKGROUND OF THE INVENTION

1. Field of the Invention

This invention relates to structural systems. In particular, this invention pertains to earth retaining systems. Still further, this invention pertains to earth retaining structures adapted to reduce the bending moments of forces on the structure and create a tension loaded system. Still more in particular, this invention pertains to structures having a frontal wall of a particular contour which is securely fastened to a similarly contoured rear wall through tension rods. More in particular, this invention relates to a structural system having elliptically contoured frontal walls and rear walls which are maintained in fixed alignment through tension rods passing therebetween. More in particular, this invention relates to an earth retaining system wherein the adjacent frontal walls lockingly engage each to the other on opposing transverse ends thereof for redistribution of loads occurring on the structural system.

2. Prior Art

Structures for containing horizontal and vertical forces are known in the art. In some prior systems where earth is to be retained, a frontal wall is provided which holds back the earth being retained. In some such prior cases, the walls were the main load bearing surfaces and bending moments were applied which caused structural failures. Thus, in such prior structural systems, the support wall members and structures had to be over sized and formed in very large dimensions in order to support the horizontal loads being applied. Thus, in such prior systems, the walls were found to be difficult to fabricate and expensive to construct with the additional disadvantage of utilizing a large amount of material which was a drain on natural resources.

Earth reenforcing structures have been known in the art. In such prior structures, layers of a granular material were interspersed with reenforcing layers and the main load bearing capabilities was formed through the frictional contact between the granular material and the reenforced material layers. These prior systems were found to be expensive to construct and caused increased labor costs and were found not be optimize the load bearing capacity of structures as is provided in the instant invention.

SUMMARY OF THE INVENTION

A tension loaded earth retaining system which includes a frontal wall extending linearly in a vertical direction. The frontal wall has an arcuate contour in a horizontal plane. The earth retaining system further includes a rear wall which is longitudinally aligned and displaced from the frontal wall and extends substantially linearly in the vertical direction. The rear wall has an arcuate contour in the horizontal plane similar to that provided for the frontal wall. A tension load distribution mechanism extends in the horizontal plane and the longitudinal direction between the frontal and rear walls and is fixedly secured to the frontal and rear walls on opposing transverse ends thereof.

BRIEF DESCRIPTION OF THE DRAWINGS

FIG. 1 is an isometric view of the earth retaining system;

FIG. 2 is a plan view of a portion of the earth retaining system as shown in FIG. 1;

FIG. 3 is an elevation view of the earth retaining system;

FIG. 4 is a plane view of a pair of frontal panels being matingly engaged with a U-channel vertical support member;

FIG. 5 is a plane view of a C-channel shaped supporting member showing interlocking of adjacently located frontal panel members;

FIG. 6 is a plane view of a T-section supporting member matingly engaging and fixedly secured to opposing adjacent transverse ends of a pair of frontal panels;

FIG. 7 is an isometric view showing a tension rod connected to a supporting member which is embedded within an assembly footing;

FIG. 8 is a plane view of a pair of adjacently interlocked frontal panel members in combination with a T-channel supporting member;

FIG. 9 is a plane view of a pair of interlocking and matingly engaged adjacent frontal panels in combination with a cylindrically contoured vertically directed supported member; and FIG. 10 is a perspective partially exploded view of interlocking front panels of the earth retaining system in combination with a cylindrically contoured vertical support member.

DESCRIPTION OF THE PREFERRED EMBODIMENTS

Referring now to FIGS. 1, 2 and 3, there is shown tension loaded structure or earth retaining system 10 which details a gravity type structure designed to structurally maintain downwardly directed forces in vertical direction 12 as well as to support forces in horizontal direction 14 either individually or in combination. In particular, earth retaining system 10 is particularly adaptable for fixedly positioning an earth mass in the rear of system 10. This prevents movement of earth 16, minimizes erosion and other dispersing effects as well as preventing movement of earth 16 onto forward base surface 18 as is clearly shown in FIG. 3. In overall concept, tension loaded earth retaining system 10 operates on the principle that structurally connected members having particularly contoured surfaces may be joined to optimize distribution of stresses therein. The load bearing surfaces of structure 10 disperse and distribute the acting load in an optimized tension dispersal manner in order to redistribute the loads over an entire structure in an optimized manner. By redistributing the applied loads on the entire structure, a system is provided which is of relatively low weight, has a minimization of material considerations, and is highly economical to fabricate.

Tension loaded earth retaining system 10 includes frontal wall, panel or skin section 20 which extends linearly in vertical direction 12. Dependent upon the amount and dimension of earth 16 to be retained in fixed position, system 10 may include a plurality of adjacently positioned frontal walls 20 as is seen in FIGS. 1, 2 and 3. Panels 20 extend substantially in transverse direction 22 and are provided with an arcuate contour in a horizontal plane defined by the directional arrows 22 and 14. The arcuate contour of frontal panels 20 are generally formed into an elliptical shape to permit the horizontal forces acting on an interior surface of walls 20 to be dispersed into a tension load along the elliptical contour. This, as is well known in the art, provides for panels 20 to minimize any bending moments occuring in walls 20 while providing for an optimization of tension stresses. Frontal walls 20 may be preformed panels made of fiberglass, galvanized steel, other metal or other suitable structural material not important to the inventive concept with the exception that such material used in panels 20 have sufficient structural integrity so as to maintain the loads without structurally failing.

Each of frontal walls 20 is maintained in fixed constrainment between a pair of frontal wall support members 24 which extend in vertical direction 12. As is seen in FIGS. 1 and 2, frontal walls 20 are mounted to frontal wall support members 24 on opposing transverse ends of each of panels 20. Frontal wall support members 24 may be T-section bars as is shown in FIGS. 1 and 2 or constructed of other shapes as will be detailed in following paragraphs. Additionally, support members 24 are formed of galvanized steel or other material having sufficient structural integrity to maintain panels 20 in fixed position without positional movement thereof due to the applied loads. Support members 24 may be mounted within assembly footing 26 as is shown in FIG. 3. Assembly footing 26 may be formed of concrete or some like substance to maintain support members 24 in a fixed vertical direction 12 or having an acute angle with respect to direction 12. FIG. 7 shows one form of support member 24 embedded in a concrete assembly footing 26. However, due to the optimization of loads, successful fabrication of system 10 has also been achieved by driving or otherwise implanting support members 24 into forward base surface 18 without the necessity of fixedly implanting members 24 within assembly footing 26.

One form of connecting panels 20 to support members 24 is shown in FIGS. 1 and 2 where in overall concept opposing transverse ends of panels 20 are mounted to a center portion or extension of the T-section through welding, bolting, or some like technique. In following paragraphs, a more efficient manner of interlocking panels 20 to support members 24 will be shown and described.

Earth retaining system 10 further includes rear wall or panel 28 which is aligned in horizontal or longitudinal direction 14 and displaced from a corresponding frontal panel 20. As in the case of frontal panels 20, rear walls 28 extend substantially in a linear manner in vertical direction 12 and has an arcuate contour in a horizontal plane defined by directional arrows 14 and 22. The arcuate contour of rear walls or panels 28 are generally elliptical in nature corresponding to the elliptical contour of forward or frontal skins 20. Thus, applied loads on rear walls 28 are dispersed into a tension type load bearing structure. Wall sections 28 are formed into adjacently and transversely directed segments and may be formed of one continuous structure or of a plurality of structural segments which are fixedly constrained each to the other.

Rear wall members 28 additionally are provided with rear wall support members 30 which extend in vertical direction 12 and constrain each contoured section of rear walls 28 on opposing transverse ends thereof similar to the manner in which frontal wall support members 24 fixedly secure panels 20. Support members 30 are driven or otherwise forced into base surface 18 to maintain rigidity against physical displacement of panels 28. Support members 30 are formed generally of rolled steel pipe or some like material which may be galvanized in order to prevent rusting or other oxidation deterioration.

As is clearly seen in FIGS. 1 and 2, rear walls 28 are formed in a major portion thereof of wire mesh screening 32 having a predetermined mesh size as will be described in following paragraphs. The upper and lower portion of mesh screen 32 includes a pair of arcuately contoured mesh screen supporting rods 34 to which screen 32 is fixedly secured. Mesh screen supporting rods 34 are displaced each from the other in vertical direction 12 as is clearly seen in FIG. 1. Supporting rods 34 enclose mesh screen 32 on an upper and lower surface and extend in a substantially horizontal plane. Securement of mesh screen 32 to upper and lower supporting rods 34 may be accomplished by tie members, welding, or some like technique not important to the inventive concept as is herein detailed. Each of rear panel or walls 28 or portions thereof may include a plurality of vertically extending stiffener rods 36 to prevent deformation of rear wall sections 28. Stiffener rods 36 are secured in fixed relation to rear walls 28 by tie members, welding, or some other like technique.

Tension loaded structure or system 10 further includes a volume of granular fill 38 in contiguous contact and positioned on opposing surfaces of rear panel or walls 28 as is shown in FIG. 3. Granular fill 38 generally takes the contour of a triangular section in a vertical plane defined by vertical direction 12 and horizontal direction 14. Granular fill 38 forms granular angle 40 between 30°–45° with a horizontal plane as is shown in the figures. Granular fill 38 has a size sufficient such that fill 38 would not be easily passable through the mesh screening size of screen 32 making up a major portion of rear wall 28. Granular fill 38 allows for drainage of water from rear walls 28 as well as providing a barrier so that earth 16 would not easily pass reversibly into and out of tension loaded system 10. Granular fill 38 passes between internal base surface 39 of system 10 and passes to the extended height of system 10 defined by rear walls 28 to provide a predetermined volume of supporting granular fill.

The internal volume of tension loaded structure 10 is generally filled with backfill material 41. Backfill material 41 is a granular type fill composed of sand, crushed rock or stone or some like substance. An important consideration is that material 41 includes an angle of friction which is greater than 22°. This permits sufficient friction between the internal granular so as to relieve abnormally large forces bearing solely on panels 20.

Earth retaining system 10 includes tension load distribution mechanisms rods or bars 42 which extend in a horizontal plane in longitudinal or horizontal direction 14. Tension bars or rods 42 are fixedly secured to frontal wall panels 20 and rear walls 28 on opposing transverse ends thereof. Tensions rods 42 may be passed through openings formed in frontal wall support members 24 and mounted in secured fashion through tension rod tie members 44 as is seen in FIGS. 1 and 2. Additionally, tension rod or bars 44 may be passed around screen supporting rods 34, screen mesh 32, and rear vertical members 30 to provide a fixed interlocking effect between these members. Once passed around members 34, 30, and 32, rods 42 may be fixedly secured through the standard tie members 44 similar to the fastening method as provided for frontal walls 20. To maintain tension rods 42 in predetermined horizontal plane position, intermediate tension rod supports 46 which are vertical directed may be inserted into base surface 18. Intermediate tension rod supports 46 may be fixedly secured to each of tension rods 42 through tension rod support wire passing around the intersection of rod supports 46 and tension rods 42 as is shown in FIG. 2.

An important concept of tension loaded structure 10 is seen in FIGS. 8, 9 and 10 providing for an interlocking concept between adjacent frontal walls or panels 20. In the manner to be shown and described in following paragraphs, a pair of adjacently and transversely directed frontal walls 20 are adapted to be releasably interlocked in order to optimize the structural integrity of system 10 and aid in distributing the overall tension load on panels 12 throughout vertical direction 12. In this structural engagement, frontal panels or walls 20 lockingly engage one to the other and optimize load bearing capabilities of earth retaining system 10. As is seen in FIGS. 8–10, each of frontal walls 20 include transverse ends having a hook or U-section 50 which is adapted for matingly engaging the other of said frontal walls 20. In this concept, each of U-sections 50 define trough or recess through opening 52 within which leg member 54 of an adjacent frontal panel 20 may be inserted. Each of panels 20 further includes panel notches 56 formed in a transverse end. Panel notches or slots 56 are formed in U-sections 50 and are longitudinally as well as vertically aligned for insertion therethrough of a respective tension rod 42 as is seen in FIG. 10. Tension rods 42 pass through aligned notches 56 as well as interlocked panels 20 and is mounted to frontal wall support member 24'. As has previously been described, tension rods 42 may be positionally located around frontal wall support members 24' and tied upon itself through standard tie members 44 as is shown in FIG. 9. In this manner, frontal panels 20 are lockingly engaged with respective tension rods 42 and support members 24' in order to achieve a relatively positionally fixed system 10.

As is shown in FIG. 8, in another embodiment of the invention, frontal wall support member 24 is in the form of a T-section. Frontal panels 20 lockingly engage in a releasable manner as has been described. Tension rods 42 pass through appropriate notches or slots formed in frontal panels 20 and further pass through transverse openings formed in T-sections. Tie members 44 are utilized in the standard way in order to provide the interlocking effect and constrainment between support members 24, tension rods 42, and front panels 20.

In an embodiment of the invention, as shown in FIG. 4, vertically directed frontal wall support members may be formed of U-channel sections 58. U-channel 58 includes a pair of transversely displaced and opposing legs 62 which extend in horizontal direction 14. As is the usual case, U-channel support member 58 extends throughout the vertical length of earth retaining system 10. Central extension 60 is welded or otherwise mounted to the base of U-channel support member 58 to provide a vertically directed mounting support for tension rods 42. Central extension 60 includes a plurality of openings in order that tension rod 42 may be passed therethrough in a transverse direction 22 and fastened to itself through tie members 44 as is clearly seen. In this embodiment, frontal panels 20 include an arcuately formed transverse panel edge 66 which passes around opposing legs 62 and is partially inserted within the central opening of U-channel support member 58. In this manner, panels 20 matingly engage in a partially interlocked manner with support member 58. Additionally, it will be noted that tension rods 42 provide for a load direction to the rear of earth retaining system 10 which further increases the interlocking effect between frontal panels and support members 58.

As shown in FIG. 5, frontal wall support members may be C-channel sections 68 which include rounded edges 72 having a thickness greater than the base portion of support member 68. Central extension 70 passes in horizontal direction 14 and may be provided with openings through which tension rods 42 may be extended and fastened onto itself through tie members 44. Frontal panel edges 66' are arcuately contoured to matingly engage rounded edges 72 and form a partial interlock between panels 20 and support members 68. As in the previous embodiment, the forces on panels 20 from the back fill within system 10, is directed to the forward area of system 10 and the tension rods 42 are providing a load directed to the rear of system 10. In this manner, panels 20 are interlockingly engaged with support members 68 in a fixed position type of relation.

FIG. 6 provides for an embodiment of tension loaded structure 10 wherein the frontal wall support members are in the form of T-section elements 24 as has been previously described. However, front panels 20 in this embodiment include planar or flatened panel edges 74 which are sandwiched between the flat plate base of support member 24 and T-plate member 76. Opposing planar panel edges 74 are mounted adjacent and contiguous each to the other and are provided with through openings in order that bolts 78 may be passed therethrough to mount fixed T-plate 76, panel edges 74 and the base plate of T-section support member 24 in a tightened and fixed relation.

Although this invention has been described in connection with specific forms and embodiments thereof, it will be appreciated that various modifications other than those discussed above may be resorted to without departing from the spirit or scope of the invention. For example, equivalent elemental structures may be substituted for those specifically shown and described, certain features may be used independently of other features, and in some cases, elements may be reversed, all without departing from the spirit or scope of the invention as defined in the appended claims.

What is claimed is:

1. A tension loaded earth retaining system comprising:

(a) a solid continuous frontal wall extending linearly in a substantially vertical direction, said frontal wall having an arcuate contour in a horizontal plane;

(b) a rear wall longitudinally aligned in a continuous manner and displaced from said frontal wall, said rear wall extending substantially linearly in said vertical direction and having an arcuate contour in said horizontal plane, said rear wall being substantially formed of a wire mesh screen having a predetermined mesh size opening; and, (c) tension load distribution means extending in said horizontal plane and said longitudinal direction, said tension load distribution means fixedly secured to said frontal wall and said rear wall on opposing transverse ends thereof, said arcuate contours of said frontal wall and said rear wall being substantially arcuately similar for distributing force loads throughout each of said walls.

2. The tension loaded earth retaining system as recited in claim 1 including a pair of frontal wall support members extending in said vertical direction, said frontal wall support members constrained to said frontal wall on opposing transverse ends thereof.

3. The tension loaded earth retaining system as recited in claim 2 including a pair of rear wall support members extending in said vertical direction, said rear wall support members constrained to said rear wall on opposing transverse ends thereof.

4. The tension loaded earth retaining system as recited in claim 3 where said pair of rear wall support members are rod members fixedly secured to a base surface for maintaining said rear wall in fixed constrainment to said base surface.

5. The tension loaded earth retaining system as recited in claim 4 where said tension load distribution means includes at least one tension rod extending from said frontal wall to said rear wall.

6. The tension loaded earth retaining system as recited in claim 5 where said tension rod is secured to said rear wall and said rear wall support rod members.

7. The tension loaded earth retaining system as recited in claim 6 where said rear wall is formed of a wire mesh screen having a predetermined mesh size opening.

8. The tension loaded earth retaining system as recited in claim 7 where said rear wall includes a pair of arcuately contoured mesh screen supporting rods, said mesh screen supporting rods being displaced each from the other in said vertical direction.

9. The tension loaded earth retaining system as recited in claim 8 where said mesh screen supporting rods extend in a substantially horizontal plane being secured to said mesh screen on opposing vertical ends thereof.

10. The tension loaded earth retaining system as recited in claim 9 where said tension rod is fixedly secured to one of said mesh screen supporting rods and one of said rear wall support members.

11. The tension loaded earth retaining system as recited in claim 10 where said tension rod is formed in closed contour around said mesh screen supporting rod and said rear wall support member, said tension rod being secured through at least one tie member.

12. The tension loaded earth retaining system as recited in claim 11 including a plurality of vertically extending stiffener rods, said stiffener rods secured in fixed relation to said rear wall.

13. The tension loaded earth retaining system as recited in claim 12 including a predetermined volume of granular fill inserted on opposing longitudinal surfaces of said wire mesh screen.

14. The tension loaded earth retaining system as recited in claim 13 where said rear wall arcuate contour is elliptical.

15. The tension loaded earth retaining system as recited in claim 1 including:

(a) a pair of vertically extending frontal wall support members constrained to said frontal wall on opposing transverse ends of said frontal wall; and, (b) a pair of vertically extending rear wall support members constrained to said rear wall, said frontal and rear support members being rigidly secured to a base surface.

16. The tension loaded earth retaining system as recited in claim 15 where said tension load distribution means includes at least one tension rod extending in said longitudinal direction, said tension rod being secured to said frontal wall and rear wall support members on opposing ends thereof.

17. The tension loaded earth retaining system as recited in claim 16 where at least one of said frontal wall support members is a vertically extending T-section member.

18. The tension loaded earth retaining system as recited in claim 17 where said tension rod is secured to a central extension of said T-section member wall support.

19. The tension loaded earth retaining system as recited in claim 18 where said frontal wall is fastened to a transverse extension of said T-section member wall support.

20. The tension loaded earth retaining system as recited in claim 16 where at least one of said frontal wall support members is a vertically extending U-section member having a central extension secured to said tension rod.

21. The tension loaded earth retaining system as recited in claim 20 where at least one transverse end of said frontal wall is contoured into an arcuate hook for interlocking with at least one opposing leg section of said U-section member.

22. The tension loaded earth retaining system as recited in claim 16 including a pair of adjacent transversely directed frontal walls adapted to be releasably interlocked.

23. The tension loaded earth retaining system as recited in claim 22 where said pair of adjacent frontal walls are adapted to matingly engage each to the other substantially throughout said vertical frontal wall extension.

24. The tension loaded earth retaining system as recited in claim 23 where said adjacent frontal walls include transverse end U-sections adapted for mating engagement of one of said frontal walls to the other of said adjacent frontal walls.

25. The tension loaded earth retaining system as recited in claim 24 where each of said frontal walls include aligned slots formed in said U-sections for insertion therethrough of said tension rod.

26. The tension loaded earth retaining system as recited in claim 16 where said frontal wall contour is elliptical.

27. The tension loaded earth retaining system as recited in claim 1 including a predetermined volume of granular fill inserted adjacent an inner surface of said rear wall.

* * * * *